US005558210A

United States Patent [19]

Jonischus

[11] Patent Number: 5,558,210

[45] Date of Patent: Sep. 24, 1996

[54] MICROSWITCH

[75] Inventor: Jürgen Jonischus, Romanshorn, Switzerland

[73] Assignee: Firma Fedag, Romanshorn, Switzerland

[21] Appl. No.: 501,540

[22] Filed: Jul. 12, 1995

[30] Foreign Application Priority Data

Jul. 12, 1994 [DE] Germany ..... 44 24 427.4

[51] Int. Cl.[6] ..... H01H 1/52

[52] U.S. Cl. ..... 200/321; 200/318; 200/334

[58] Field of Search ..... 200/318, 323, 200/324, 325, 333, 334, 43.16, 330, 331, 332, 573, 318.1, 318.2, 43.01, 43.02, 43.04, 43.07, 43.09

[56] References Cited

U.S. PATENT DOCUMENTS 3,849,615 11/1974 Fisher ..... 200/333

5,428,197 6/1995 McCurry et al. ..... 200/302.2

*Primary Examiner*—David J. Walczak

*Attorney, Agent, or Firm*—Robert W. Becker & Associates

[57] ABSTRACT

The switching device for actuating an electrical drive motor of a working tool has a housing and a microswitch, including a switching pin for switching on and off the microswitch, positioned in the housing. An actuating element for actuating the switching pin is positioned in the housing so as to be accessible from the exterior of the housing. A switching mechanism with a plurality of members including the switching pin and the actuating element is provided. One of the members of the switching mechanism is moveable into an operating position in which the microswitch is operative and into a switched-off position in which the microswitch is switched off. A locking element for arresting the moveable member in the operating position is provided. A releasable safety stop is releasably connected to the housing. The locking element rests on the releasable safety stop. When the releasable safety stop is released, the moveable member is switched into the switched-off position.

22 Claims, 8 Drawing Sheets

Fig. 7
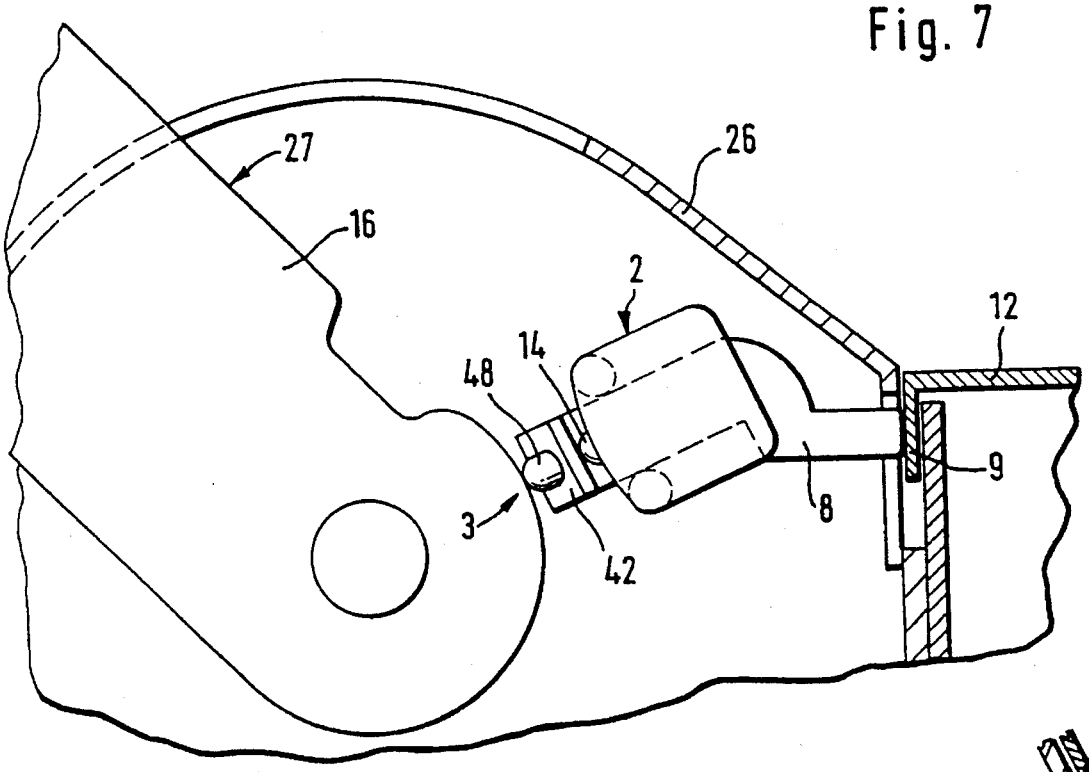
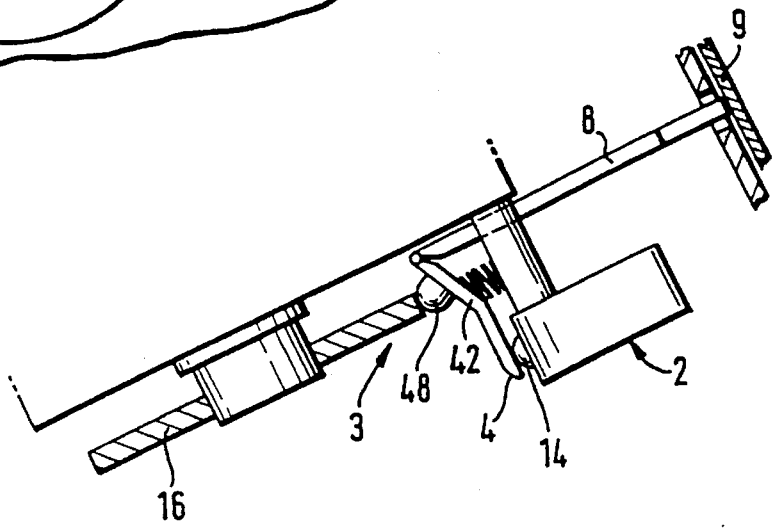
Fig. 8

Fig. 9
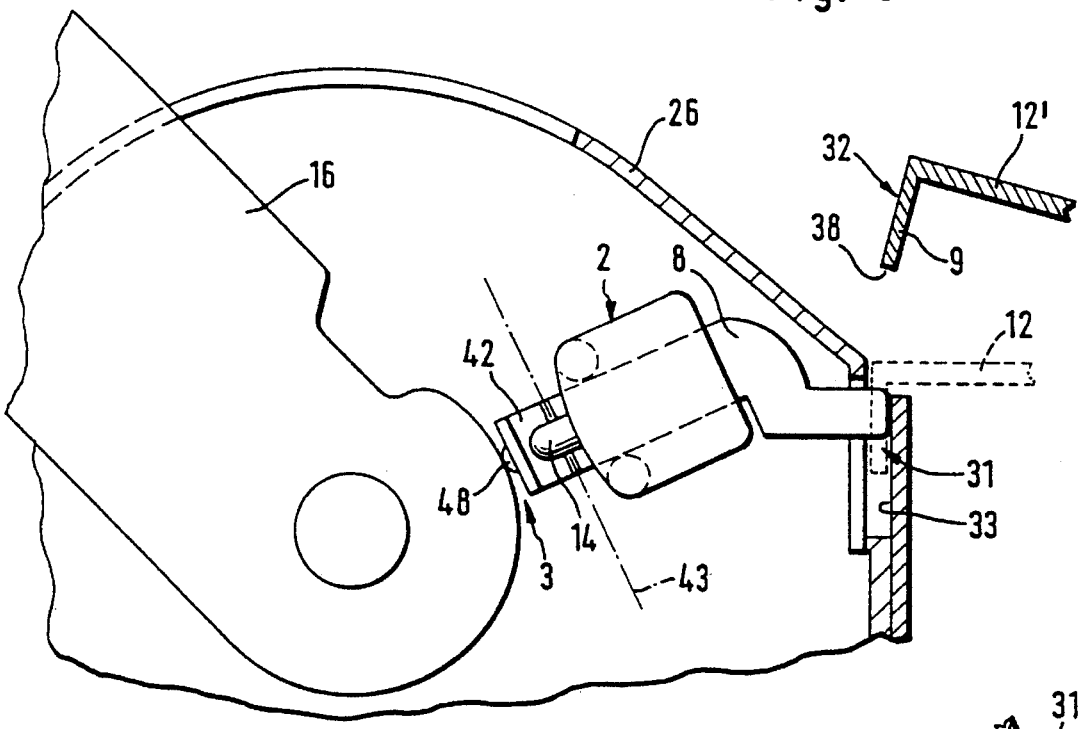
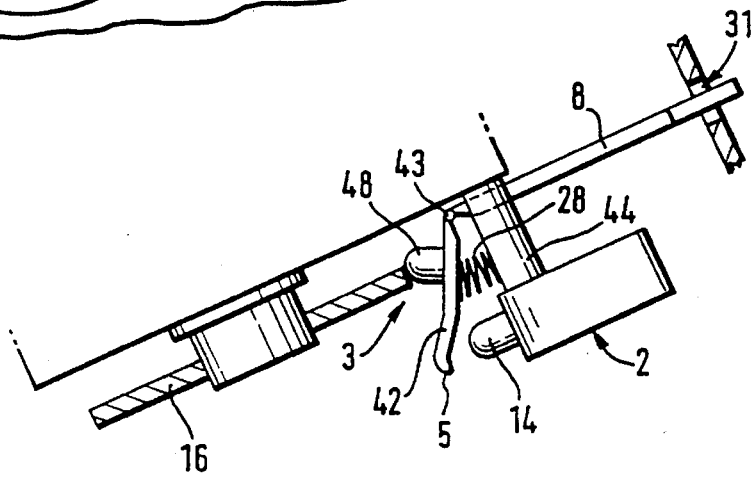
Fig. 10

MICROSWITCH

BACKGROUND OF THE INVENTION

The present invention relates to a switching device for actuating an electrical drive motor of a working tool, for example, a vacuum cleaner. The switching device includes a microswitch with a switching pin for switching the microswitch on and off and an actuating element for actuating the switching pin.

Microswitches provided with a switching pin for operating an electrical drive motor of a working tool, for example, a household appliance like a vacuum cleaner, are known. With their help power to the drive motor can be supplied, respectively, interrupted. The switching pin can be switched on and off by an actuating element which protrudes through the casing of the appliance toward the exterior and can be actuated by the operator. Such microswitches are robust and can be manufactured easily; however, they are not able to carry out other operations than the switching on and off function. In particular, it is not possible with these microswitches to prevent, while the motor is running, the operator from reaching into the working tool into rotating members which is dangerous to the operating person, without providing additional safety measures.

It is, therefore, an object of the invention to suggest a microswitch with which an actuating of the drive motor in a dangerous situation can be securely prevented.

SUMMARY OF THE INVENTION

The switching device for actuating an electrical drive motor of a working tool according to the present invention is primarily characterized by:

a housing;

a microswitch, comprising a switching pin for switching on and off the microswitch, positioned in the housing;

an actuating element for actuating the switching pin positioned in the housing so as to be accessible from the exterior of the housing;

a switching mechanism comprising a plurality of members including the switching pin and the actuating element, wherein one of the members of the switching mechanism is moveable into an operating position in which the microswitch is operative and into a switched-off position in which the microswitch is switched off;

a locking element for arresting the moveable member in the operating position;

a releasable safety stop releasably connected to the housing;

the locking element resting on the releasable safety stop; and wherein, when the releasable safety stop is released, the moveable member is switched into the switched-off position.

Preferably, the moveable member is the switching pin.

In another embodiment of the invention, the moveable member is a transfer lever positioned between the switching pin and the actuating element.

The transfer lever is connected to the locking element and is preferably supported at the locking element so as to be pivotable about a pivot axis. Advantageously, the transfer lever has an end face and is pivotably connected with the end face to the locking element.

The switching pin is preferably positioned at a greater distance to the pivot axis than a point of contact between the actuating element and the transfer lever.

In another embodiment, the switching pin and a point of contact between the actuating element and the transfer lever are positioned at opposite ends of the transfer lever.

The microswitch is expediently pivotable about a pivot axle fixedly connected to the housing.

The switching device preferably further comprises a stop fixedly connected to the housing, wherein in the switched-off position the switching pin rests at the stop.

The microswitch advantageously comprises a projection which is unitary with the microswitch and wherein the projection forms the locking element.

The locking element is a stop pin that is movably connected to the microswitch.

Preferably, a guide connected to the housing is provided in which guide the stop pin is guided translatorily.

The switching device amy further comprise a spring connected to the stop pin for biasing the stop pin such that the moveable member is biased into the operating position, wherein the force of the spring is smaller than an actuating force acting on the moveable member for switching on the microswitch. Preferably, the safety stop is a pivotable member of the working tool. The pivotable member is expediently a cover. When the cover is in an open position, the moveable member is in the switched-off position.

The actuating element is a pivot lever having a contour with projections and recesses defining the operating position and the switched-off position.

The pivot lever is pivotable about an angular range of substantially 90°, wherein each one of the end positions of the pivot lever within the angular range defines the switched-off position.

Preferably, a stop lever is provided, wherein the pivot lever has a contour with depressions and wherein the stop lever engages lockingly in the end positions and in an intermediate position of substantially 45° one of the depressions of the contour of the pivot lever.

The stop lever expediently comprises a locking portion biased in the direction of engaging the depressions.

A release lever for releasing the stop lever from the depressions is advantageously provided.

According to the invention, a switching mechanism for switching the microswitch is provided. This mechanism comprises at least the actuating element and the switching pin and a member of this switching mechanism is designed to be moveable from an operating position to a switched-off position. This member of the switching mechanism is the switching pin in a preferred embodiment and can be locked in its operating position by a locking element which is supported on a releasable safety stop and can be moved into the switched-off position when the safety stop is released. During operation the safety stop prevents that the locking element, due to an actuating force acting on the switching pin of the microswitch, is moved into a position disabling the switching mechanism such that the drive motor is inadvertently turned off. On the other hand, as a safety measure, the microswitch cannot be switched on if the locking element is not supported on the safety stop which, for example, can be formed as a casing portion covering the drive motor as well as further rotating members of the working tool.

In a preferred embodiment, the microswitch is designed to be pivotable about a fixedly mounted pivot axle whereby the switching pin is moved from its operating position into its non-operating position. The locking element can be designed as a stop pin that is pivotably (movably) connected with the microswitch. A free end thereof is supported on the releasable safety stop in the operating position. Preferably, the stop pin is spring-loaded in the direction of the operating position, with the force of the spring being lower than the actuating force acting on the switching pin. Thus, it is ensured that the switching pin is transferred into its switched-off position when the safety stop is released; on the other hand, the switching pin can be easily moved back into its operating position in any position of the appliance whereby the switching mechanism is enabled again.

According to a further embodiment it is suggested to provide a transfer lever between the actuating element and the switching pin; advantageously this transfer lever is pivotably supported on the locking element and, in the operating position, transfers the actuation of the actuating element onto the switching pin. When the safety stop is released, the locking element travels into a recess and moves the transfer lever into the switched-off position in which the drive motor cannot be turned on.

Advantageously, the safety stop is a member of the working tool and can be swivelled, like, for example, a cover. Therefore, additional safety measures which are to prevent a reaching in from the exterior can be left out.

BRIEF DESCRIPTION OF THE DRAWINGS

The objects and advantages of the present invention will appear more clearly from the following specification in conjunction with the accompanying schematic drawings, in which:

FIG. 7 illustrates the embodiment according to FIG. 5, in operating position;

FIG. 8 shows a plan view of the embodiment according to FIG. 7;

FIG. 9 illustrates the embodiment according to FIG. 5, in a switched-off position with the safety stop being released;

FIG. 10 shows a plan view of the embodiment according to FIG. 9; and

DESCRIPTION OF THE PREFERRED EMBODIMENTS

Figure 1:
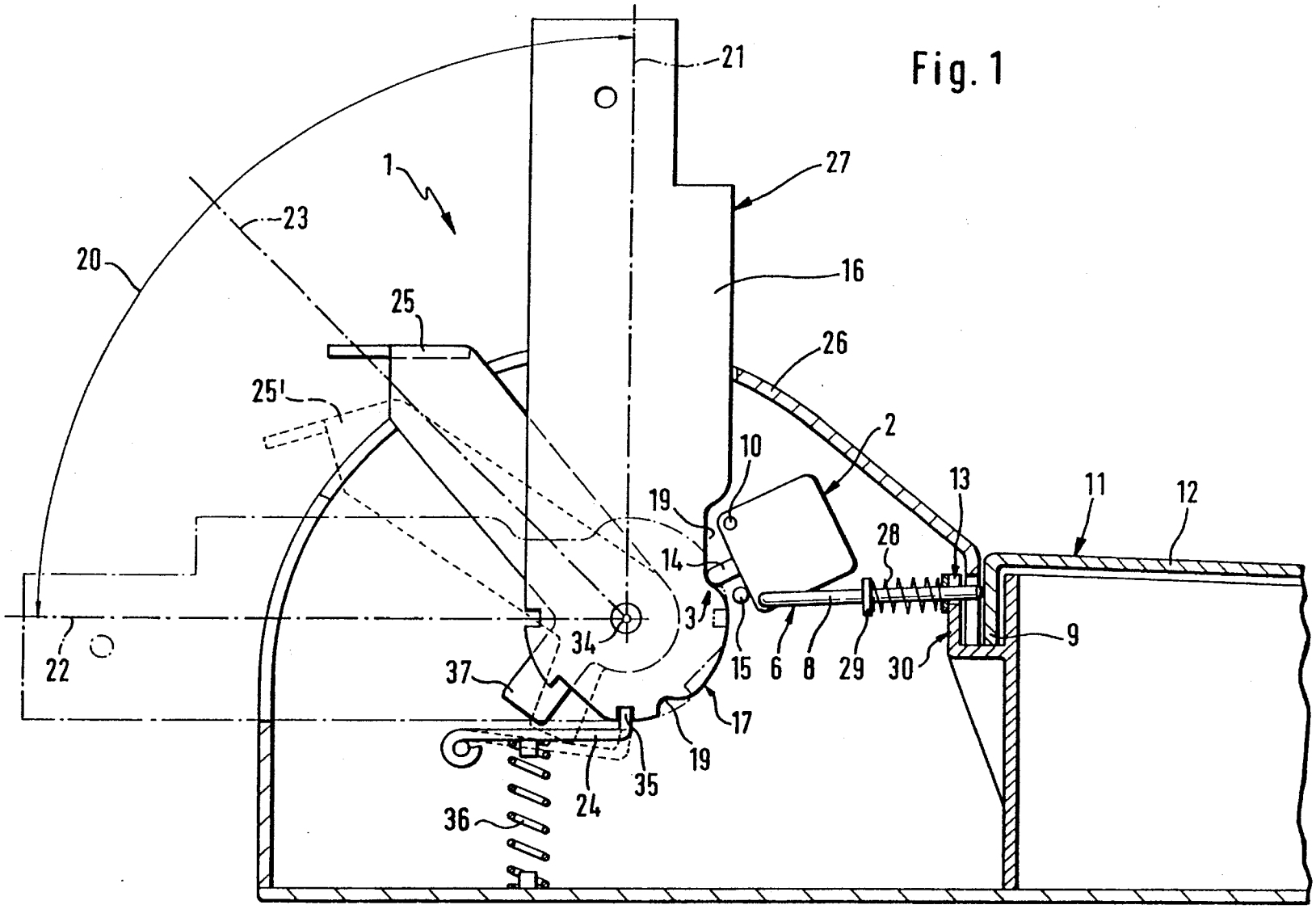
FIG. 1 shows a side view of the inventive microswitch with a switching mechanism comprising an actuating element and a switching pin, illustrated in switched-off position of the microswitch.

FIG. 1 illustrates a cross-sectional side view of a working tool 1, for example, a household appliance like a vacuum cleaner, with a microswitch 2 for actuating a not illustrated electrical drive motor. The microswitch is mounted in a housing 26 and can be actuated from the exterior via an actuating element 27 which is designed in the illustrated embodiment as a rotatable pivot lever 16 penetrating the housing wall. In FIG. 1 the microswitch 2 is illustrated in a switched-off position; a switching pin 14 of the microswitch 2 that can be pushed into the micro-switch 2 for activating it (activation position), abuts the pivot lever 16 and, in conjunction with it, forms a switching mechanism 3 for transferring the switching travel onto the switching pin 14.

Figure 2:
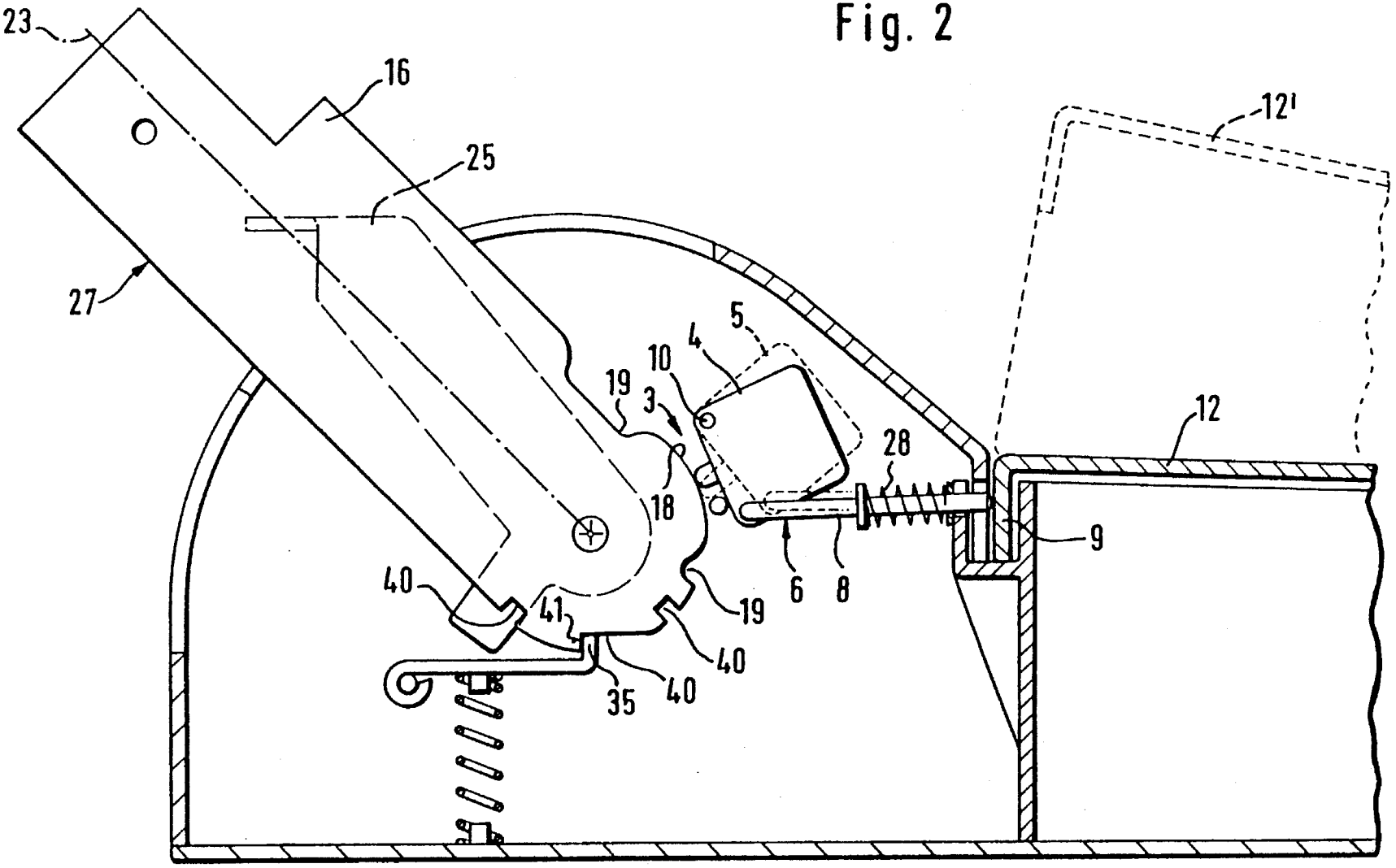
FIG. 2 shows a microswitch in a switched-on position (solid lines)

The microswitch 2 is pivotably supported on a fixedly mounted pivot axle 10 and can, as is illustrated in FIG. 2, be pivoted into two positions by rotation about the pivot axle 10. In order to prevent an inadvertent rotation of the microswitch 2 from the operating position 4 (FIGS. 1 and 2) into the switched-off position 5 (FIG. 3) in which the switching pin 14 is in the extended deactivation position, a locking element 6 is arranged at the microswitch 2; in FIGS. 1, 2, and 3, the locking element 6 is embodied as a stop pin 8 that is pivotably connected to the microswitch. In the operating position 4, its free end, positioned opposite the microswitch 2, abuts a safety stop 9. When the stop pin 8 abuts the safety stop 9, the operating position of the switching pin 14 is fixedly defined; a slipping of the stop pin 8 and the microswitch 2, due to switching forces acting on the switching pin 14, are precluded so that the switching mechanism 3 is enabled.

According to a not illustrated embodiment, the microswitch can also be displaced translatorily.

Figure 3:
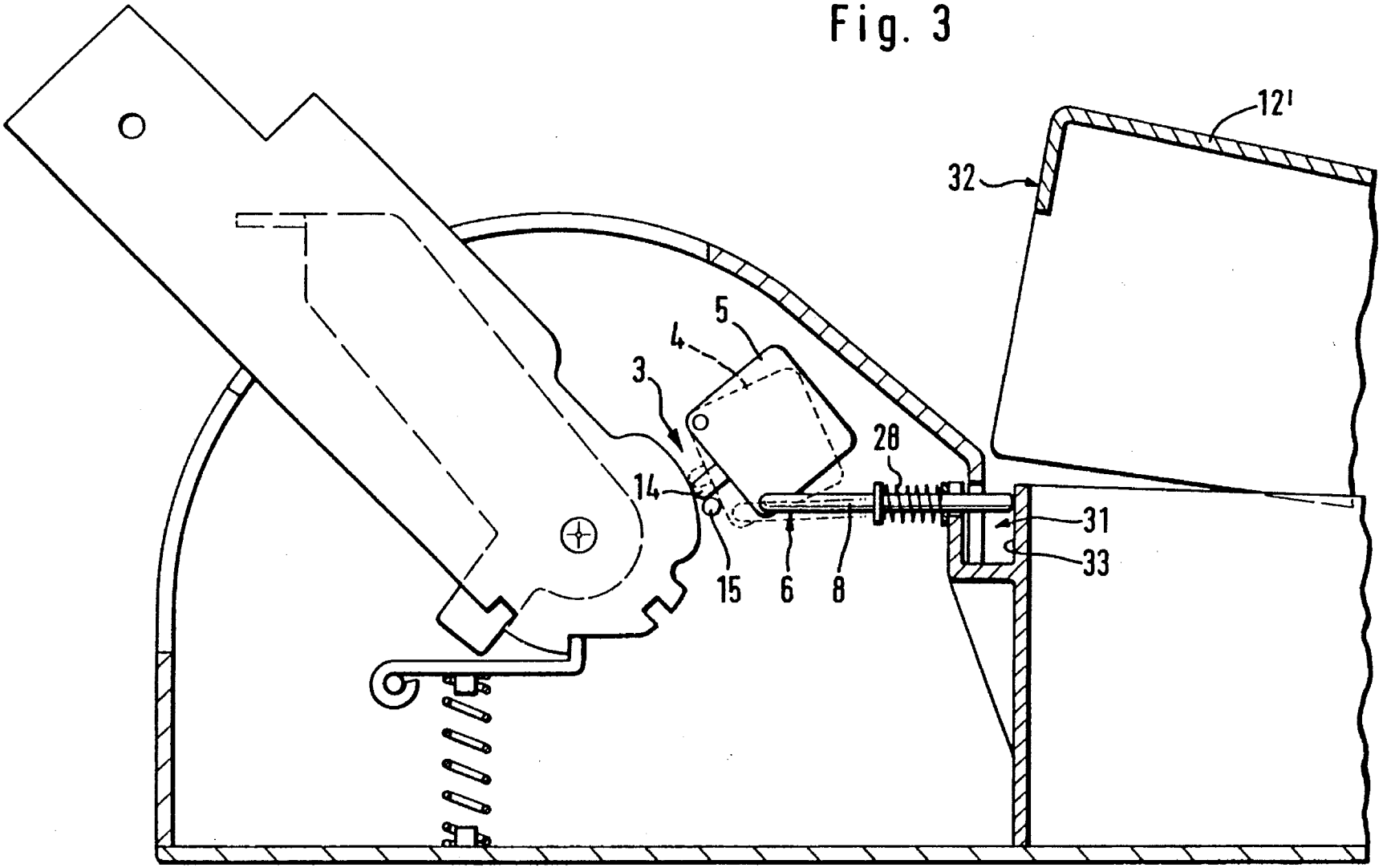
FIG. 3 illustrates the microswitch in a switched-off position (solid lines) with the safety stop being released.

The stop pin 8 is essentially translatorily movable in a guide 13 that can, for example, be formed by a recess or a bore 31 within the housing wall (FIG. 3). Expediently, the stop pin 8 is spring-loaded in the direction of the operating position 4 for which purpose a spring 28 is provided that encloses the stop pin 8 and is arranged on a part 29 that is designed as a sleeve which is slipped onto the stop pin 8 to be axially freely movable. The part 29 has a closed end face opposite the microswitch. The spring 28 is a compression spring; however, its compression force, at any position of the microswitch, is lower than the switching force that acts on the switching pin 14 and that is required for switching on the drive motor. Releasing the safety stop 9 from its blocking position results in the stop pin 8 traveling into the recess 31, due to the pressure of the switching force acting on the switching pin 14, and in the switching pin 14 arriving at its switched-off position by rotation of the microswitch 2. However, if the switching force acting on the switching pin 14 is reduced, the microswitch 2 can travel back into the operating position 4 by the force of the compression spring 28, independent of the position of the appliance (see FIGS. 2 and 3).

The spring 28 can also be formed as an tension spring, one end of which is attached to the means 29 designed as a ring flange being formed as a unitary part with the stop pin and the other end of which is supported on the interior wall 30 of the housing 26. The spring action of the spring 28 results in the stop pin 8 being pulled deeper into the recess 31 by the force of the spring when the safety stop 9 is swivelled off its blocking position; thereby, the switching pin 14 is displaced from its operating position into its switched-off position.

In a particularly simple embodiment the spring 28 can be omitted as long as it is ensured that a switching force acting on the switching pin 14 for displacing the locking element and the microswitch 2 from the operating position 4 into the switched-off position 5 is lower than the force required for starting the drive motor. Thereby it remains ensured that the microswitch 2 is pivoted under the action of the switching force when the safety stop 9 is opened, without the switching pin 14 being switched into its operating position; the part 29 may then be omitted. If the switching force for swivelling the microswitch is not acting, stop element and microswitch can, at least in the working position of the appliance, also return into the operating position 4 due to the own weight of the microswitch.

The safety stop 9 is expediently designed as a pivotable member 11 of the appliance 1, for example, a cover 12, which can be removed for cleaning and maintenance in the case of a vacuum cleaning appliance with a brushing roller. With this embodiment it is securely prevented that the drive motor can be activated in the lifted position of the cover 12' illustrated in FIGS. 2 and 3. In the lifted position, the front wall 32, forming the safety stop 9, of the cover, is lifted off the recess 31 such that the stop pin 8 can travel farther into the recess 31 and the switching pin 14 is moved from its operating position 4 into its switched-off position 5. Now, the microswitch 2 cannot be actuated any more so that maintenance and cleaning of those parts located under the cover 12, like the brushing roller or the like, are possible without any risk of injury.

The swivelling path of the microswitch 2 can be blocked by a further, fixedly mounted stop 15 at which the switching pin 14 of the microswitch 2 advantageously rests in the switched-off position 5 in order to limit a maximum rotation of the microswitch 2 and to facilitate the return into the operating position. The end position can also be determined by the free end of the stop pin 8 hitting a rear wall 33 of the casing 26 after releasing and lifting the cover 12, according to FIG. 3. In order to facilitate a return of the switching pin 14 from the switched-off position into the operating position, it may be advisable to provide the free end of the front wall 32 of the cover 12, according to a non-illustrated embodiment, with a tapered surface that facilitates a return of the stop pin 8 against the force of the spring 28 on closing the cover 12. Moreover, the stop 15 is helpful when the appliance is assembled since the mounting position of the microswitch 2 is clearly defined by it.

The switching pin 14 of the microswitch 2 can be actuated by rotating the pivot lever 16 that projects through the wall of the housing 26 to the exterior. The switching pin 14 abuts the contour 17 of the pivot lever 16 at an approximately concentric distance to the pivot axis 34 and engages projections 18 and recesses 19 of the contour 17. A switched-off position of the microswitch 2 (FIG. 1) is defined by the switching pin 14 engaging recesses 19, whereas a switched-on position is defined when the switching pin 14 abuts a projection 18 and is pushed into the microswitch 2, see FIG. 2. According to FIG. 1, the pivoted lever 16 can be advantageously swivelled at an angular range 20 of approximately 90° from a vertical end position 21 into a horizontal end position 22. The end positions 21 and 22 each define a switched-off position in which the switching pin 14 engages a recess 19 of the contour 17. However, in an intermediate position 23 of preferably approximately 45°, the switching pin 14 abuts a projection 18 by means of which the switching pin 14 is pushed into the microswitch 2 and the drive motor is started.

Figure 4:
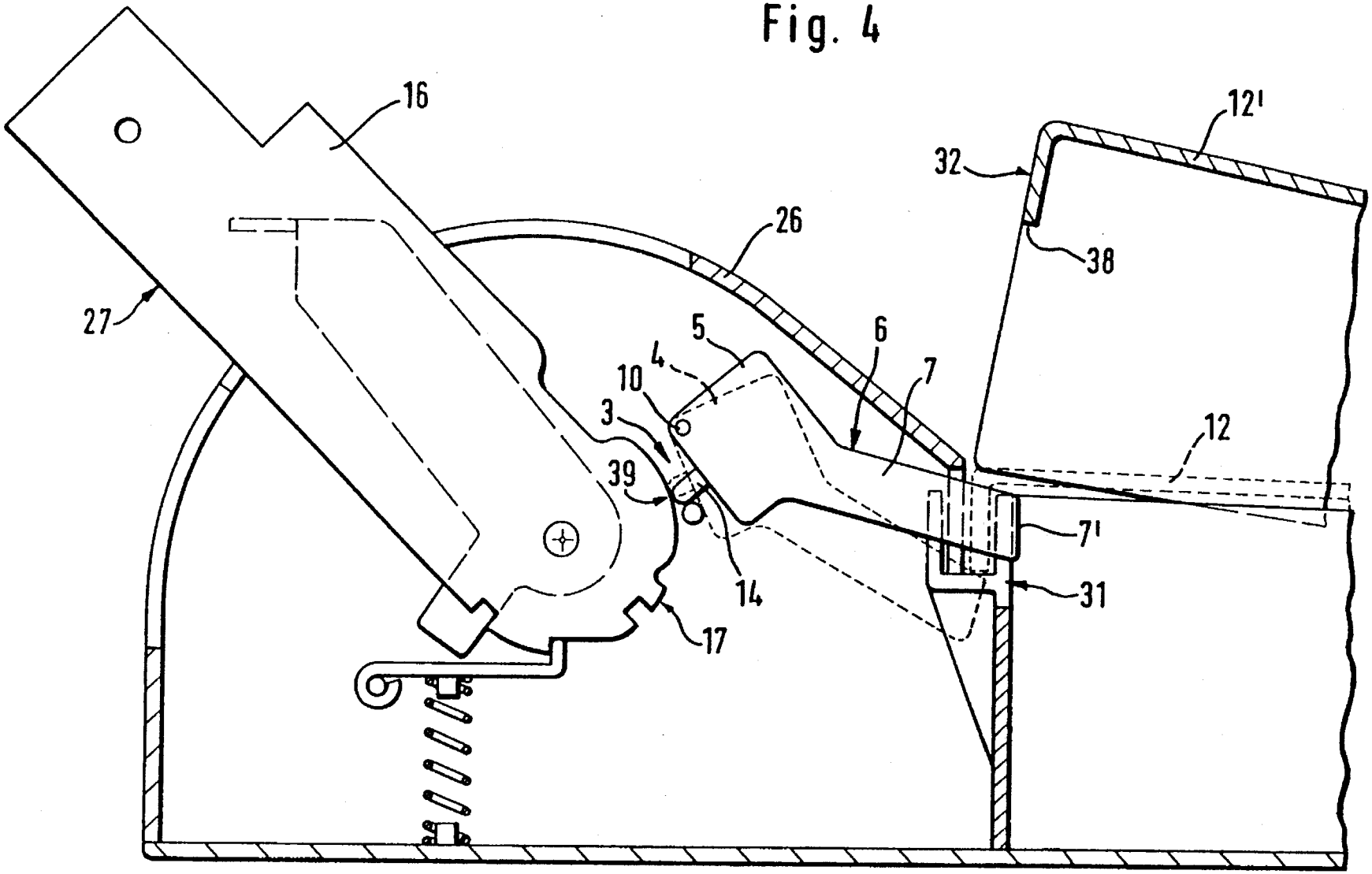
FIG. 4 illustrates the microswitch according to FIG. 3 with a locking element of a different design.

In a further embodiment according to FIG. 4, the locking element 6 of the microswitch 2 can also be designed as an projection 7 that forms a unitary member together with the microswitch 2 and is a portion of the enclosure of the microswitch. The free end 7' of the projection 7 protrudes through the recess 31 within the wall of the housing 26 at the switched-off position 5. In the operating position 4, the projection 7 is pushed downward by the bottom edge 38 of the front wall 32 of the cover 12 and is kept in this position. The transfer from the operating position 4 into the switched-off position 5 is carried out by the force of a spring, not illustrated, or by a transversely acting force at the resting point 39 located between the contour 17 of the pivoted lever 16 and the switching pin 14; the transversely acting force is located at a distance to the pivot axle 10 of the microswitch and a torque acting on the microswitch 2 is thus formed.

FIGS. 5 to 11 illustrate a further embodiment in which the switching mechanism 3 comprises the actuating element 27, an adjustable transfer lever 42 and the switching pin 14; the same reference numerals are used for the same members. In this embodiment, the microswitch 2 is fixedly connected to the casing 26 by screw connections 44. The operating position 4 (FIGS. 5 to 8) and the switched-off position 5 (FIGS. 9 to 11) are exclusively determined by the position of the transfer lever 42. As is illustrated in the plan views of FIGS. 6, 8, and 10, the locking element 6 which is formed by the stop pin 8 is designed to be off-set parallel to the microswitch 2. The stop pin 8 is translatorily displaceable in a guide 45 (not illustrated in detail) and can travel deeper into the recess 31 of the wall of the casing 26 when the safety stop 9 is released by lifting the cover 12' (FIGS. 9 and 11), whereby the transfer lever 42 is positioned in the switched-off position 5 and the switching mechanism 3 is disabled.

At one end face 46, the transfer lever 42 is mounted at the locking element 6 so as to be pivotable about a pivot axis 43. The free end of the transfer lever 42 projects past the switching pin 14 of the microswitch 2 such that the switching pin 14 can be switched on by a rotating movement of the transfer lever 42.

On the opposite side of the switching pin 14, an actuating means 48 is arranged as to be connected with the transfer lever as a single piece and it abuts the contour 17 of the pivoted lever 16. The actuating member 48 is arranged at a shorter distance to the pivot axis 43 than the switching pin 14.

Figure 5:
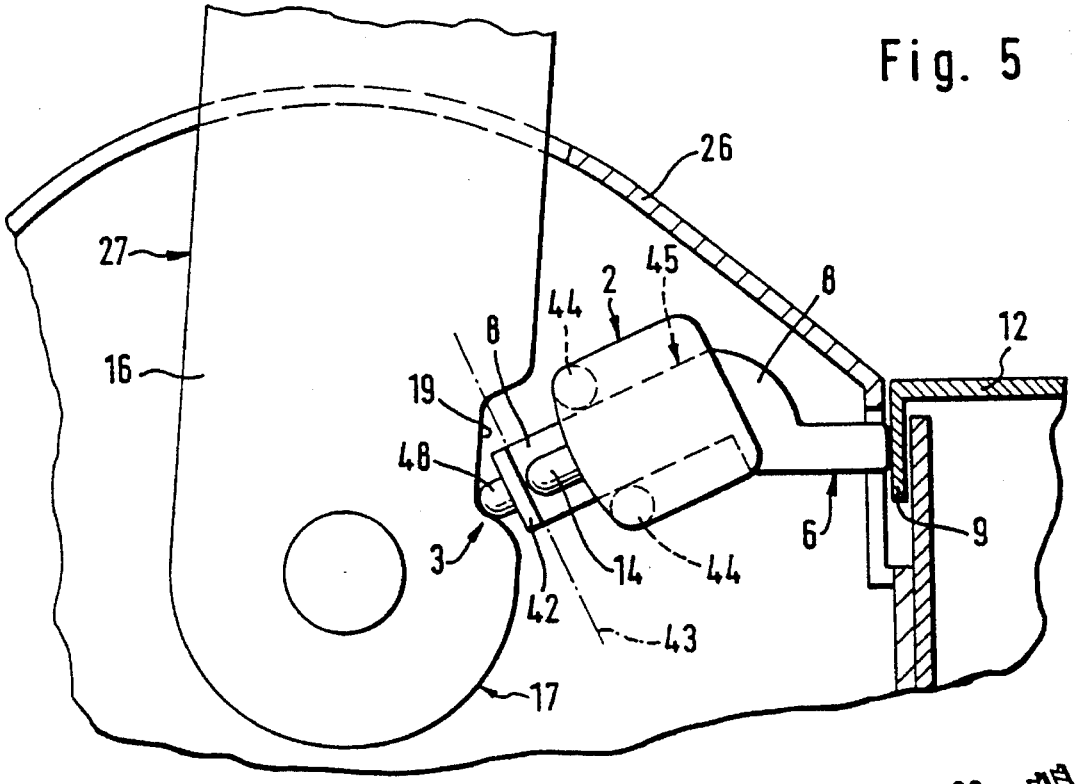
FIG. 5 shows a cross-section according to FIG. 1 with a microswitch and a switching mechanism comprising actuating element, transfer lever, and switching pin.
Figure 6:
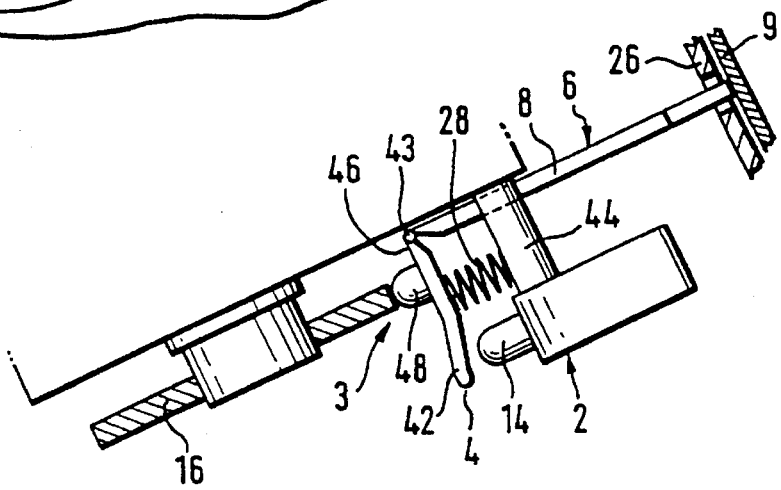
FIG. 6 shows a plan view of the embodiment according to FIG. 5.

An actuating movement carried out by the pivot lever 16 from the switched-off position according to FIGS. 5 and 6 to an operating position according to FIGS. 7 and 8 results in the actuating member 48 to be pushed down and thus a rotation of the transfer lever 42 which moves the switching pin 14 of the microswitch 2 into the operating position. Due to the greater distance of the switching pin 14 to the pivot axis 43 than to the actuating member 48, even a short actuating travel acting on the actuating member 48 is sufficient for carrying out the required lift for moving the switching pin 14 into the operating position.

During this process, the actuating travel carried out by the pivot lever 16 is transformed into a pure rotating movement of the transfer lever 42 since the stop pin 8 with its free end abuts the safety stop 9 and cannot withdraw translatorily.

Figure 11:
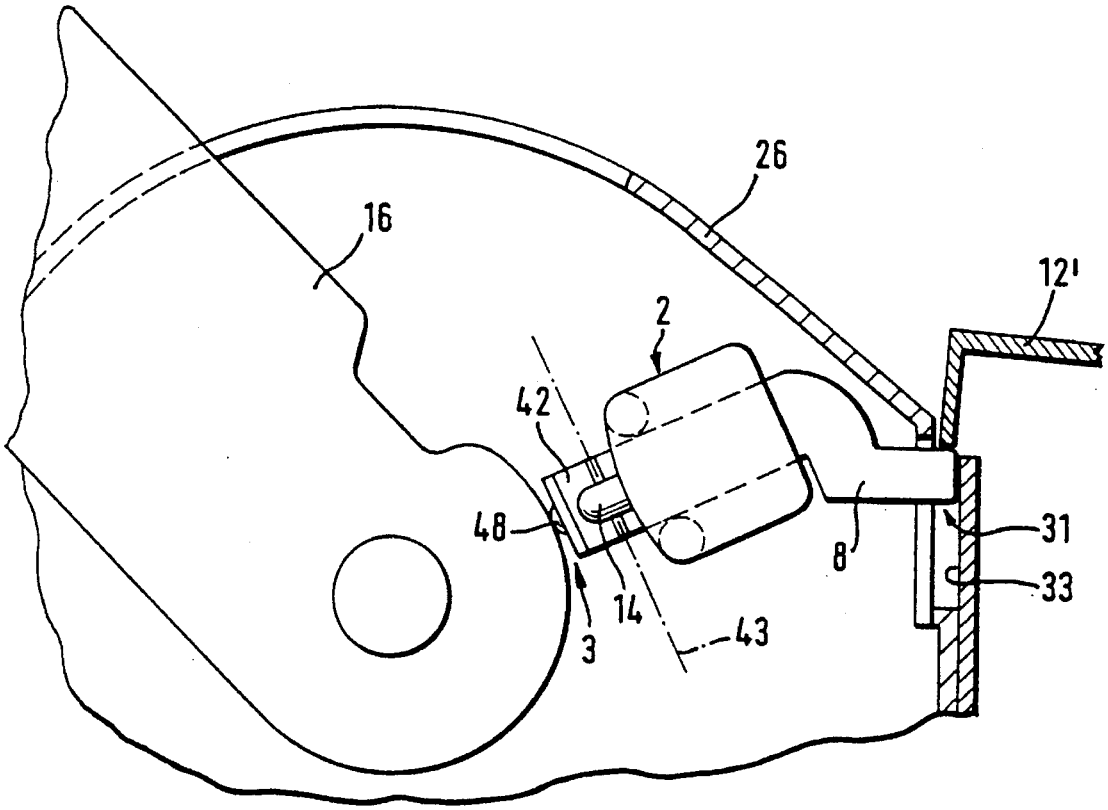
FIG. 11 shows a cross-section according to FIG. 9 with the safety stop being blocked.

FIGS. 9, 10, and 11 illustrate the transfer lever 42 in the switched-off position 5 in which the switching mechanism 3 is disabled and the microswitch 2 is not switched on. The cover 12, the front wall 32 of which forms the safety stop 9, is in a lifted position, removed from the recess 31, whereby the stop pin 8 is backwardly displaced into abutment at a rear wall 33 due to the force of the pivot lever acting on the actuating means 48.

At the surface of the transfer lever 42, opposite the actuating member 48, a spring 28, preferably a coil spring, is arranged. Its end positioned opposite the transfer lever 42 is supported at the screw connection 44 by which the microswitch 2 is mounted to the housing. Relative to the pivot axis 43, the spring 28 is designed to be located between the actuating means 48 and the switching pin 14. An actuating movement of the pivot lever 16 in the direction of the switched-off position 5 of the transfer lever 42 leads to a force acting onto the spring 28 which results in the transfer lever 42 to open due to the greater distance of the spring 28 relative to the pivot axis 43 than to the actuating member 48. This causes the stop pin 8 to be displaced into the recess 31 whereby the transfer lever is moved into the switched-off position 5. Through the opening of the transfer lever 42, the point of application of force between pivot lever 16 and actuating member 48 shifts from the tip to the lateral mantle surface of the actuating member 48 such that the transfer levers 42, when the stop pin 8 is displaced further into the recess 31, is opened further and further due to the pressure of the spring 28. Accordingly, the actuating movement of the pivot lever 16 is more and more oriented in the direction of the translatory movement of the stop pin 8. By the opening of the transfer lever 42, it is securely prevented that the free end of the transfer lever can act on the switching pin 14 and thus may lead to an inadvertent starting of the drive motor.

When the pivot lever 16 is returned into its starting position according to FIGS. 5 or 6, the actuating member 48 slips into the recess 19 of the contour 17 of the pivot lever 16 under the force of the spring 28. Simultaneously the stop pin 8 is pulled out of the recess 31 and returned from the switched-off position 5 into operating position 4.

According to a non-illustrated embodiment the spring 28 can also be omitted, as long as it is ensured that the force required for switching on the switching pin 14 is higher than frictional forces within the supporting location of the stop pin 8 and within the pivot axle, respectively the location of contact 47 between pivot lever 16 and actuating members 48. If the spring is omitted, an actuating movement of the pivoted lever 16 will press the transfer lever 42 onto the switching pin 14 even if the safety stop is released; however, with increasing actuating travel of the pivot lever 16, the switching-on force within the switching pin 14 will result in the stop pin 8 to be displaced into the recess 31 before the operating position of the switching pin 14 is reached. If the actuating movement of the pivot lever 16 is reversed, the transfer lever 42 can again be returned into the operating position 4 by the force within the switching pin 14. This procedure can be supported by bevelling the lower edge 38 of the safety stop 9 whereby the insertion of the cover 12 into its stop position is facilitated when the stop pin 8 is not or only partly retracted.

According to FIG. 1, moreover, a stop lever 24 expediently abuts the contour 17 of the pivot lever 16 and is offset downwardly by approximately 90 degrees relative to the microswitch 2. A locking portion 35 is formed at one free end of the stop lever 24 and engages further recesses 40 of the pivot lever 16 in a locking manner in the two end positions 21 and 22 as well as at the intermediate position 23 and thus prevents a rotation of the pivot lever 16. As a result, the end positions 21 and 22 in which the microswitch 2 is switched off, independent of the position of the cover 12, as well as the intermediate position 23 in which the microswitch is switched on, can be locked. The stop lever 24 is supported at the housing wall by a spring 36, and the locking portion 35 of the stop lever 24 is pressed against the contour 17 of the pivoted lever 16 by the force of the stopping spring 36. A release lever 25 is provided for releasing the locking portion 35 from engagement. It is pivoted about the same pivot axis 34 as the pivot lever 16 and protrudes through the opening within the wall of the housing 26 to allow actuation. The release lever 25 is provided with a tooth-shaped projection 37 which contacts the upper surface of the stop lever 24 when the operator pushes the release lever 25 down and thus releases the locking engagement by the locking portion 35 of the stop lever 24 by pushing it out of the recess 40. A swiveling of the pivot lever 16 is thus again possible until the locking portion 35 again engages a recess 40 in a locking manner. During the swivelling movement of the pivot lever 16, the tooth-shaped projection 37 always contacts the upper surface of the stop lever 24 due to a self-locking friction, for example, within the pivot joint of the release lever 25, and is being forced back into its upper starting position by the force of the spring 36 when the locking portion 35 again engages a recess 40. Advantageously, the friction is higher than the torque acting about the pivot axis 34 and caused by the weight of the release lever, such that the stop lever 24 is relieved from the weight of the release lever 25 after the swivelling process is terminated.

At its intermediate position 23, the pivot lever 16 is advantageously only locked in the direction of its horizontal end position 22 in order to prevent an unintentional downward swivelling due to the weight of the pivot lever 16. For this reason, the locking portion 35 abuts, according to FIG. 2, a projecting portion 41 of the recess 40, whereas the side of the contour opposite the projecting portion 41 is open so that the pivot lever 16 can be swivelled upwardly by the operator into its upper end position 21 (FIG. 1) without actuating the release lever 25.

In the case of a vacuum cleaner, the pivot lever 16 is expediently identical with the lower section of the grip bar of the vacuum cleaning appliance, respectively, it forms a projection, onto which the grip bar can be slipped. In this case, the intermediate position 23 defines the working position, whereas storing positions of the appliance are determined by the end positions 21 and 22.

The present invention is, of course, in no way restricted to the specific disclosure of the specification and drawings, but also encompasses any modifications within the scope of the appended claims.

What I claim is:

1. A switching device for actuating an electrical drive motor of a working tool, said switching device comprising:

a housing;

a microswitch, comprising a switching pin for switching on and off said microswitch, positioned in said housing;

an actuating element projecting from said housing for actuating said switching pin positioned in said housing;

a switching mechanism comprising a plurality of members including said switching pin and said actuating element:

said switching mechanism having an operating position in which a switching stroke of said actuating element is transferred onto said switching pin to move said switching pin from a deactivation position in which said microswitch is switched off into an activation position in which said microswitch is switched on;

said switching mechanism having a switched-off position in which the stroke of said actuating element is not transferred onto said switching pin and in which said microswitch is switched off;

wherein said switching mechanism is returned from said operating position into said switched-off position by moving one of said members from an enabling position within said switching mechanism into a disabling position within said switching mechanism;

a locking element for arresting said moveable member in said enabling position;

a releasable safety stop releasably connected to said housing;

said locking element resting on said releasable safety stop; and wherein, when said releasable safety stop is released, said moveable member is moved from said enabling position into said disabling position.

2. A switching device according to claim 1, wherein said moveable member is said switching pin.

3. A switching device according to claim 1, wherein said moveable member is a transfer lever positioned between said switching pin and said actuating element.

4. A switching device according to claim 3, wherein said transfer lever is connected to said locking element.

5. A switching device according to claim 4, wherein said transfer lever is supported at said locking element so as to be pivotable about a pivot axis.

6. A switching device according to claim 5, wherein said transfer lever has an end face and is pivotably connected with said end face to said locking element.

7. A switching device according to claim 5, wherein said switching pin is positioned at a greater distance to said pivot axis than a point of contact between said actuating element and said transfer lever.

8. A switching device according to claim 5, wherein said switching pin and a point of contact between said actuating element and said transfer lever are positioned at opposite ends of said transfer lever.

9. A switching device according to claim 1, wherein said microswitch is pivotable about a pivot axle fixedly connected to said housing.

10. A switching device according to claim 9, further comprising a stop fixedly connected to said housing, wherein in said switched-off position said switching pin rests at said stop.

11. A switching device according to claim 1, wherein said microswitch comprises a projection which is unitary with said microswitch and wherein said projection forms said locking element.

12. A switching device according to claim 1, wherein said locking element is a stop pin that is movably connected to said microswitch.

13. A switching device according to claim 12, further comprising a guide connected to said housing in which said stop pin is guided translatorily.

14. A switching device according to claim 12, further comprising a spring connected to said stop pin for biasing said stop pin such that said moveable member is biased into said operating position, wherein the force of said spring is smaller than an actuating force acting on said moveable member for switching on said microswitch.

15. A switching device according to claim 1, wherein said safety stop is a pivotable member of the working tool.

16. A switching device according to claim 15, wherein said pivotable member is a cover.

17. A switching device according to claim 16, wherein, when said cover is in an open position, said moveable member is in said switched-off position.

18. A switching device according to claim 1, wherein said actuating element is a pivot lever having a contour with projections and recesses defining said operating position and said switched-off position.

19. A switching device according to claim 18, wherein said pivot lever is pivotable about an angular range of substantially 90° between end positions, wherein each one of the end positions of said pivot lever within said angular range defines said switched-off position.

20. A switching device according to claim 19, further comprising a stop lever, wherein said pivot lever has a contour with depressions and wherein said stop lever engages lockingly in said end positions and in an intermediate position of substantially 45° one of said depressions of said contour of said pivot lever.

21. A switching device according to claim 20, wherein said stop lever comprises a locking portion biased in the direction of engaging said depressions.

22. A switching device according to claim 20, further comprising a release lever for releasing said stop lever from said depressions.

* * * * *